US006880551B2

(12) United States Patent
Yeung

(10) Patent No.: US 6,880,551 B2
(45) Date of Patent: Apr. 19, 2005

(54) RANGE HOOD CLEANING FLUID HEATING CHAMBER

(75) Inventor: Peter Yeung, 4446 Frances Street, Burnaby, British Columbia (CA), V5C 2R4

(73) Assignee: Peter Yeung, Burnaby (CA)

( * ) Notice: Subject to any disclaimer, the term of this patent is extended or adjusted under 35 U.S.C. 154(b) by 0 days.

(21) Appl. No.: 10/394,551

(22) Filed: Mar. 21, 2003

(65) Prior Publication Data

US 2004/0055592 A1 Mar. 25, 2004

(30) Foreign Application Priority Data

Sep. 25, 2002 (CA) ..... 2405239

(51) Int. Cl.[7] ..... F24B 13/00
(52) U.S. Cl. ..... 126/299 E; 126/299 R
(58) Field of Search ..... 126/299 R, 299 D

(56) References Cited

U.S. PATENT DOCUMENTS 3,751,885 A * 8/1973 McNeely ..... 96/242
3,795,181 A 3/1974 Lawson
4,085,735 A 4/1978 Kaufman et al.
4,259,945 A 4/1981 Lawson
5,027,790 A 7/1991 Chern
5,158,429 A * 10/1992 Chiang et al. ..... 415/121.3
5,323,762 A * 6/1994 Chiang et al. ..... 126/299 E
5,456,244 A 10/1995 Prasser
5,469,837 A * 11/1995 Chiang et al. ..... 126/299 D
6,662,800 B1 * 12/2003 Yeung ..... 126/699
6,712,068 B1 * 3/2004 Yeung ..... 126/299 E
6,732,729 B1 * 5/2004 Yeung ..... 126/299 D

* cited by examiner

*Primary Examiner*—Alfred Basichas
(74) *Attorney, Agent, or Firm*—Glenn Patent Group; Michael A. Glenn

(57) ABSTRACT

A range hood cleaning fluid heating chamber that may be connected to a motor housing in a range hood. The cleaning fluid heating chamber comprises an outer shell, which defines an enclosure that is shaped and sized to fit along a portion of the periphery of the motor housing, preferably in abutment. The heating chamber has an inlet and an outlet and cleaning fluid within the heating chamber draws heat from the motor housing when the range hood is in operation. Alternatively, the cleaning fluid heating chamber may comprise an outer shell and a length of piping sandwiched between the periphery of the motor housing and the outer shell. As a further alternative, the heating chamber may simply take the form of a conduit adjacent the motor housing. The heated cleaning fluid may be used for cleaning surfaces within the range hood.

4 Claims, 6 Drawing Sheets

RANGE HOOD CLEANING FLUID HEATING CHAMBER

FIELD OF THE INVENTION

The present invention relates to range hoods for use above a cooking surface, and more particularly to a cleaning fluid heating chamber for a range hood wherein cleaning fluid used to remove grease from the fans and interior of a motor housing is heated.

BACKGROUND OF THE INVENTION

Range hoods are used above cooking surfaces to remove grease, common odors and hazardous gases created during the cooking process. Typically, range hoods for domestic use have a pair of motors horizontally installed in a motor housing within the hood body. Each motor drives a fan. The fans draw air from the cooking area below and force it through the motor housing to ventilation piping.

As the vaporized grease in the entrained air travels through the motor housing, some of it condenses on the inside walls of the housing and may accumulate. It is therefore known to provide a cleaning fluid under pressure in order to clean the interior of the exhaust system. U.S. Pat. No. 4,259,945 teaches an exhaust system in which a cleaning fluid under pressure is used to clean the flue and fan. Further washing fluid systems are taught in U.S. Pat. Nos. 3,795,181 and 4,085,735. These prior art cleaning systems are specific to their respective range hood/exhaust duct designs and each relies on an external source of cleaning fluid.

It is also known in the art to place a refillable reservoir within the interior of the range hood so as to provide an internal supply of washing fluid. The reservoir is typically constructed of plastic in order to remove any concerns with respect to rust and is attached to the upper surface of the range hood body, towards the front of the range hood and separate from the motor housing. Fluid delivery means connected to the reservoir deliver fluid under pressure from the reservoir to the interior surfaces of the range hood, in particular the motor housing. The reservoir may be filled through a coverable hole located in the range hood exterior. Once used, the washing fluid and any grease travelling therewith drains to an external grease receptacle.

Because the reservoir is spaced apart from the motor housing, the temperature of the fluid contained within it remains at approximately room temperature. However, cleaning fluid becomes more effective at removing grease as its temperature increases. In addition, there is limited space available to accommodate the reservoir within the range hood body so its size remains limited and it must be refilled regularly.

It is therefore an object of an embodiment of the present invention to provide a range hood having an increased capacity for cleaning fluid so that the cleaning fluid reservoir need be refilled less often than those of the prior art.

It is a further object of an embodiment of the present invention to provide a range hood in which the cleaning fluid is heated above room temperature.

Other objects of the invention will be apparent from the description that follows.

SUMMARY OF THE INVENTION

According to the present invention there is provided a cleaning fluid heating chamber for use in a range hood having a motor housing having a periphery defined by top, bottom and perimeter side surfaces. The cleaning fluid heating chamber comprises a solid outer shell defining an enclosure and shaped to be positioned substantially adjacent a portion of the periphery of the motor housing.

In another aspect of the invention, the heating chamber has an inlet and an outlet. The heating chamber may be made of a heat conducting material.

In another aspect of the present invention the heating chamber is in abutment with the motor housing.

In a further aspect of the invention the range hood further comprises a cleaning fluid reservoir adapted to deliver cleaning fluid to the heating chamber via the inlet.

In yet a further aspect of the invention, the heating chamber further comprises a conduit contained within the enclosure. The conduit may take the form of a length of piping.

According to an alternative embodiment of the present invention there is provided a cleaning fluid heating chamber for use in a range hood having a motor housing having a periphery defined by top, bottom and perimeter side surfaces. The cleaning fluid heating chamber comprises a solid outer shell defining an enclosure and a conduit contained within the enclosure.

In another aspect, the heating chamber according to the alternative embodiment of the present invention is positioned substantially adjacent the periphery of the motor housing.

In yet another aspect, the conduit is made of a heat conducting material. For example, the conduit may take the form of a length of piping, which piping may be sandwiched in layers within the enclosure. The piping may be in abutment with a portion of the periphery of the motor housing. The piping, having an inlet and an outlet, may be made of a heat conducting material such as copper.

According to yet a further alternative embodiment of the present invention there is provided a cleaning fluid heating chamber for use in a range hood having a motor housing having a periphery defined by top, bottom and perimeter side surfaces. The heating chamber comprises a conduit having an inlet and an outlet, the conduit being positioned substantially adjacent a portion of the periphery of the motor housing.

Other aspects of the invention will be appreciated by reference to the detailed description of the preferred embodiment and to the claims that follow.

BRIEF DESCRIPTION OF THE DRAWINGS

These and other features of the invention will become more apparent from the following description in which reference is made to the appended drawings and wherein.

DETAILED DESCRIPTION OF THE PREFERRED EMBODIMENT

Figure 1:
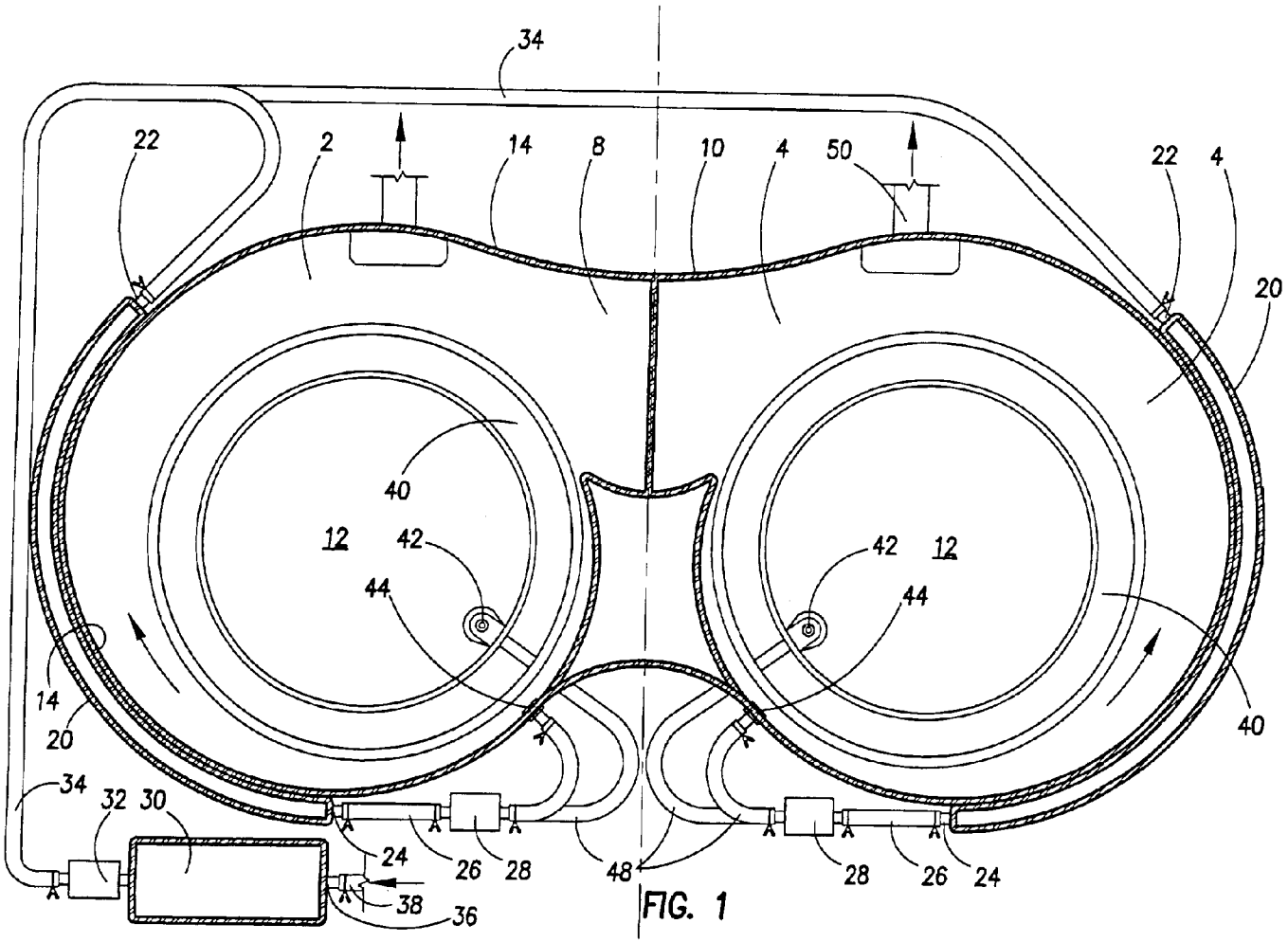
FIG. 1 is a sectional view through the top of a motor housing with a cleaning fluid heating chamber according to the preferred embodiment of the invention.
Figure 2:
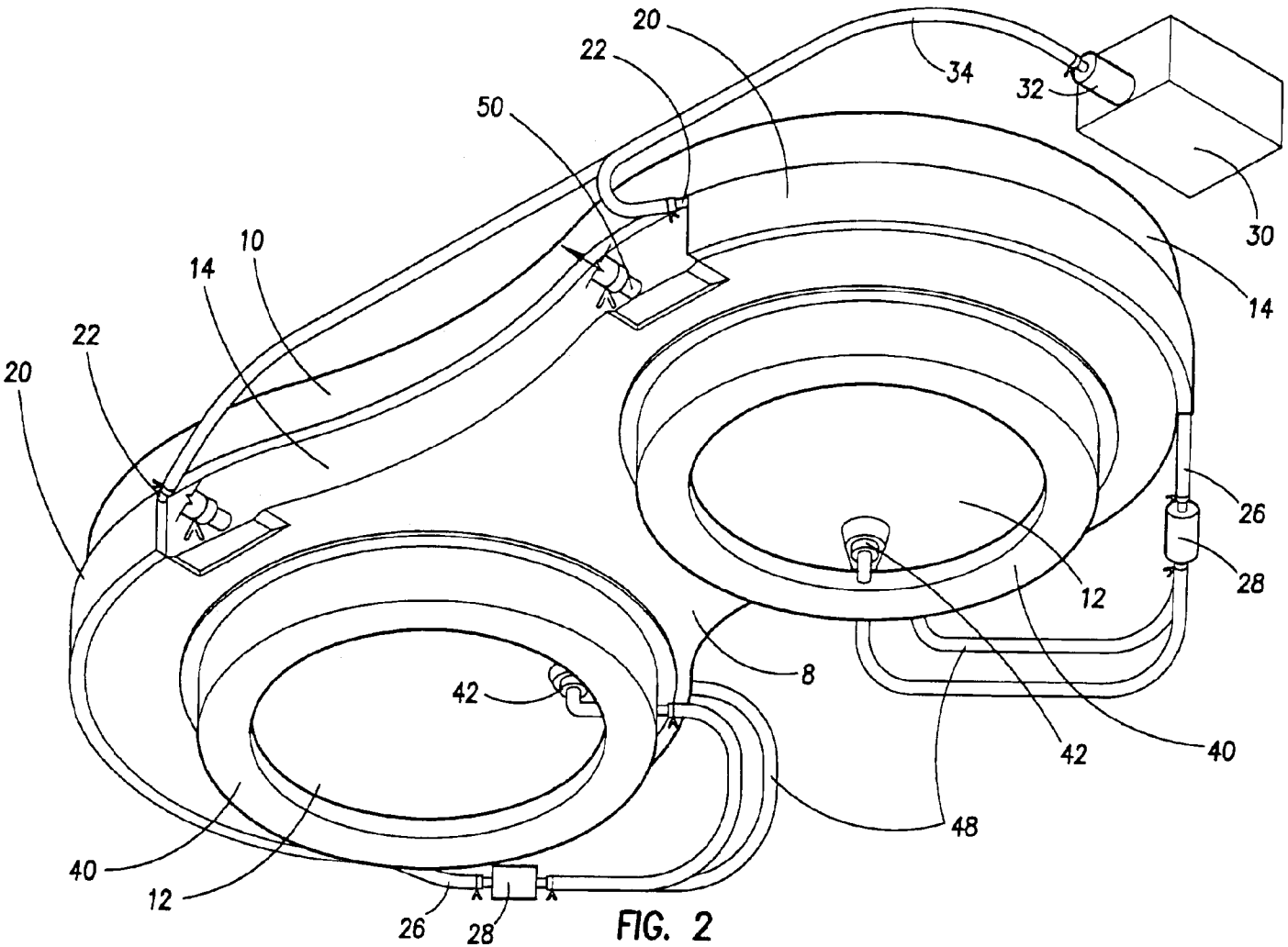
FIG. 2 is a perspective view from the rear of the motor housing and cleaning fluid heating chamber shown in FIG. 1.

The preferred embodiment of a cleaning fluid heating chamber 20 according to the invention is shown in FIGS. 1 and 2. Alternative embodiments are shown in FIGS. 3 through 6.

FIGS. 1 and 2 show a motor housing 10 having the cleaning fluid heating chamber 20 of the present invention. The motor housing 10 defines an enclosure and is mountable within a further enclosure formed by a range hood body (not shown). The outer periphery of the motor housing is defined by a top surface (not shown), a bottom surface 8 and a perimeter side wall 14, which when viewed from the top of the motor housing generally defines a figure-eight. Preferably the motor housing is made of metal and is coated to prevent rust. The interior of the housing 10 may be coated with a non-stick material so as to facilitate grease removal and is separated into two substantially similar, separate chambers 2 and 4, as shown in FIG. 1.

Each respective chamber 2, 4 has an air inlet 12 defined in the bottom surface 8 of the motor housing 10 and a ventilation hole (not shown), to which may be attached a grease tray 40. Each chamber is designed to accommodate a motor and fan (not shown) which act to draw hot, grease laden air from above the cooking surface, into the chambers 2, 4 of the motor housing 10 and out the ventilation holes.

The cleaning fluid heating chamber 20 has a solid outer shell defining an enclosure. They are shaped so as to follow the perimeter side wall 14 from the front to the rear of the motor housing as shown best in FIG. 1. Preferably, a pair of heating chambers 20 are positioned such that the heating chambers 20 are located at opposite sides of the motor housing. While it is preferred that the heating chambers be constructed of a heat conducting material such as copper and be in abutment with the motor housing, it is contemplated that other materials such as plastic could be used and that the heating chambers 20 need only be positioned adjacent and in close proximity to the motor housing 10. While the use of plastic would not provide the same amount of heat transfer from the motor housing 10 to the cleaning fluid within the heating chamber, it is more convenient and less costly to use. The heating chambers 20 extend approximately half way up the perimeter side wall of the motor housing, however the precise positioning is not essential. The bottom surfaces of the heating chambers 20 are in substantially the same plane as the lower surface 8 of the motor housing 10. Preferably, the heating chamber 20 is fixedly attached to the motor housing 10, however this is not essential.

Preferably, cleaning fluid is poured through an opening in the range hood exterior (not shown) through hose 38 and inlet 36 into reservoir 30. Activation of pump 32 results in cleaning fluid being pumped through conduit 34 to inlets 22 and into heating chambers 20. Once in heating chamber 20, the excess heat generated by the motor housing when it is in use heats the cleaning fluid. This heat originates from the cooking surface. Hot gases that are drawn into the motor housing 10 heat the motor housing. Through natural conduction, this heat energy is passed through the outer shell of heating chamber 20 and into the cleaning fluid, thereby raising its temperature above that of the normal room temperature and making it more effective at removing grease that it comes into contact with when used for cleaning purposes.

Fluid delivery means connected to the heating chambers 20 deliver the cleaning fluid under pressure from the heating chambers to the interior surfaces of the range hood, in particular the motor housing. In the preferred embodiment cleaning fluid passes out the heating chambers 20 through outlets 24 where it travels through hoses 26 to pumps 28. The pumps 28 force the cleaning fluid through conduits 48 to nozzles 42 and 44, which direct a spray of cleaning fluid against surfaces of the range hood requiring cleaning. It is contemplated that other fluid delivery means could be used, the essential aspect being that the heating chamber have an inlet so that it may be filled with cleaning fluid and an outlet so that the heated cleaning fluid may then be used for cleaning purposes. It is also contemplated that the heating chamber could be filled directly through a hole in the range hood exterior, thereby obviating the need for an additional, separate cleaning fluid reservoir.

The addition of the heating chambers 20 provides additional storage area for cleaning fluid. When combined with the storage capacity of the reservoir 30, the heating chambers allow a range hood to contain a greater volume of cleaning fluid than the prior art designs having only cleaning fluid reservoirs. In addition, the heating chambers utilize only existing space within the range hood body, so the overall size of the range hood need not be increased in order to accommodate it.

Figure 3:
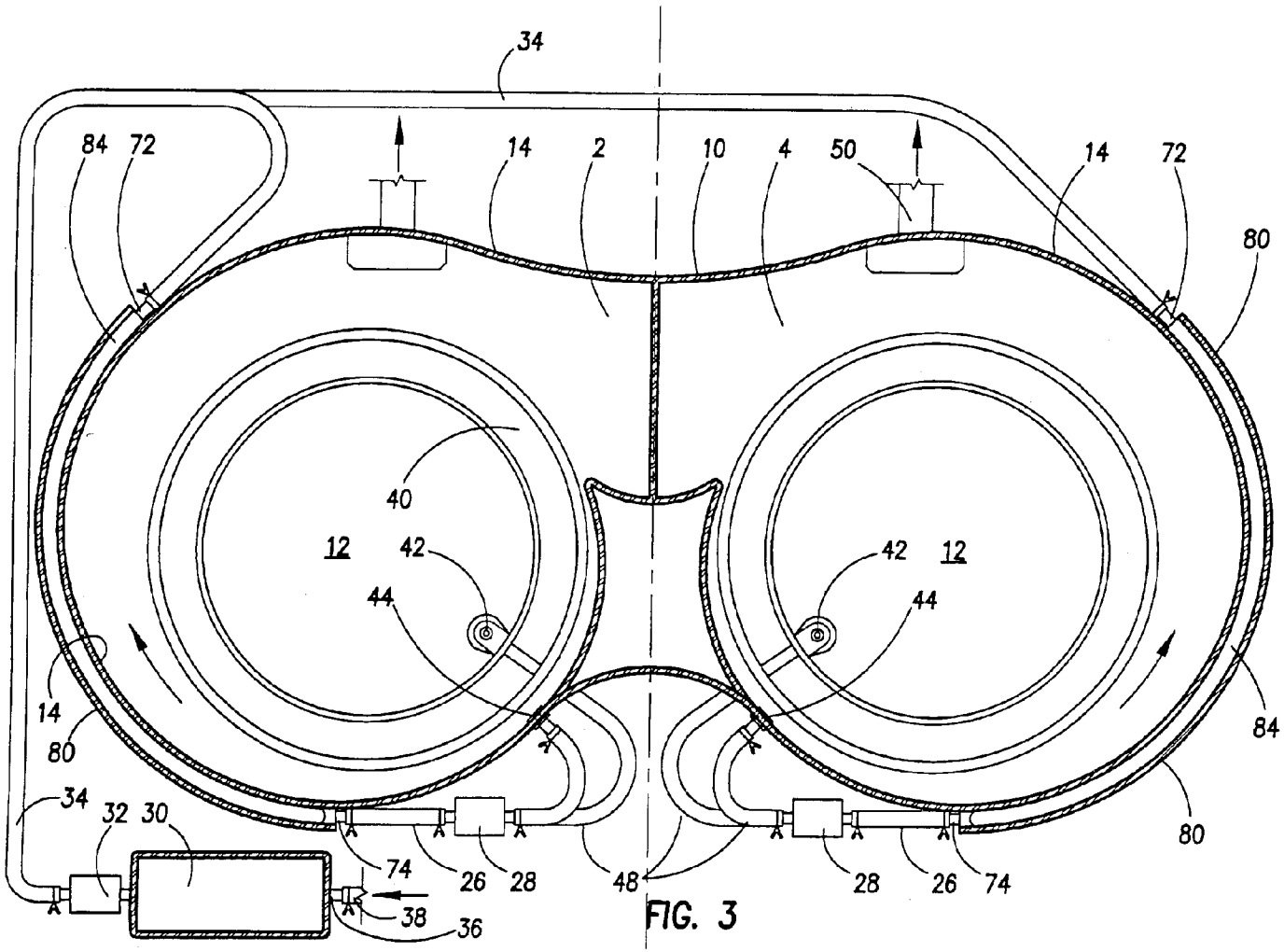
FIG. 3 is a sectional view through the top of a motor housing with a cleaning fluid heating chamber according to an alternative embodiment of the invention.
Figure 4:
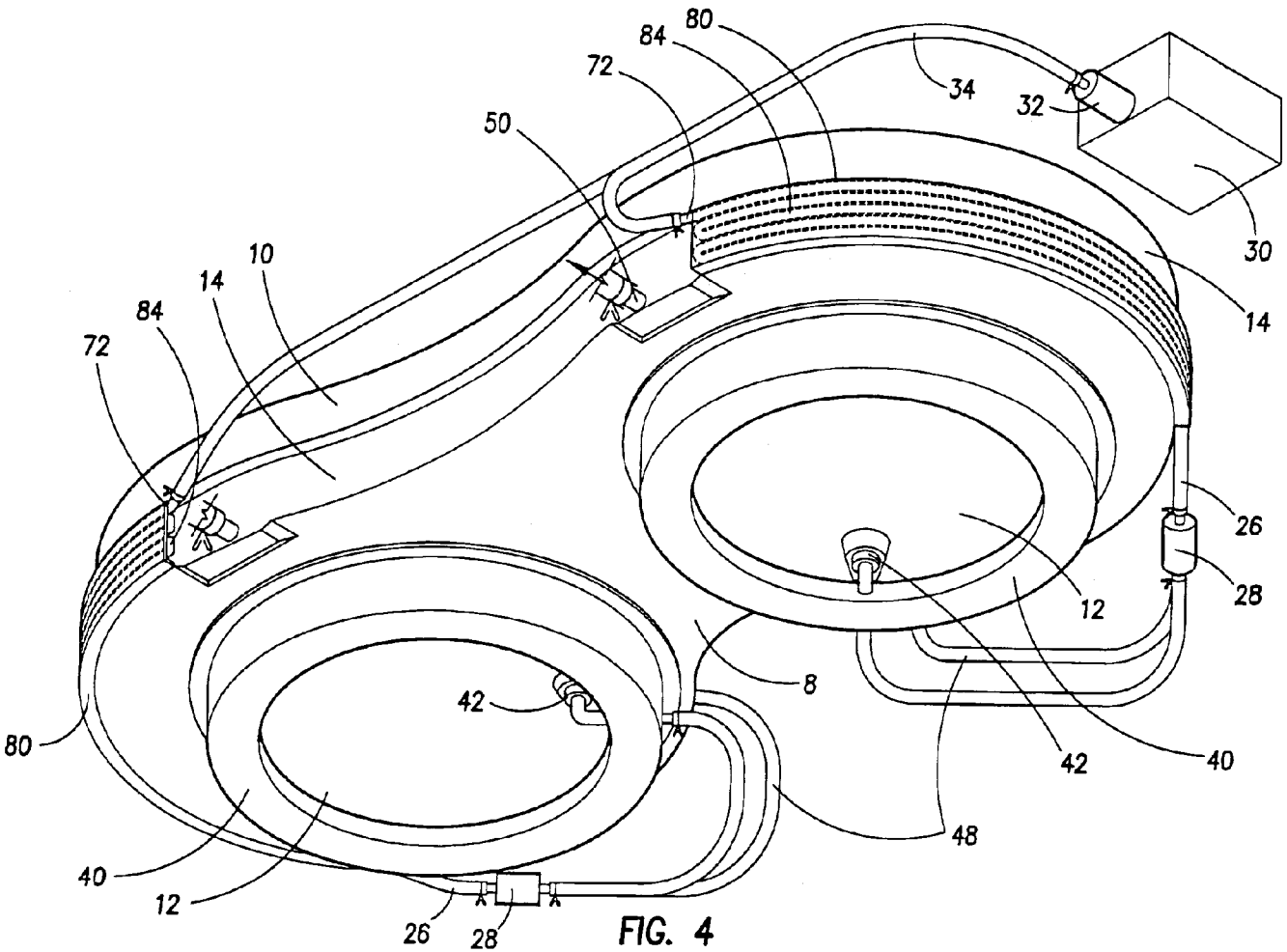
FIG. 4 is perspective view from the rear of the motor housing and cleaning fluid heating chamber shown in FIG. 3, and showing the piping contained within the heating chamber.
Figure 5:
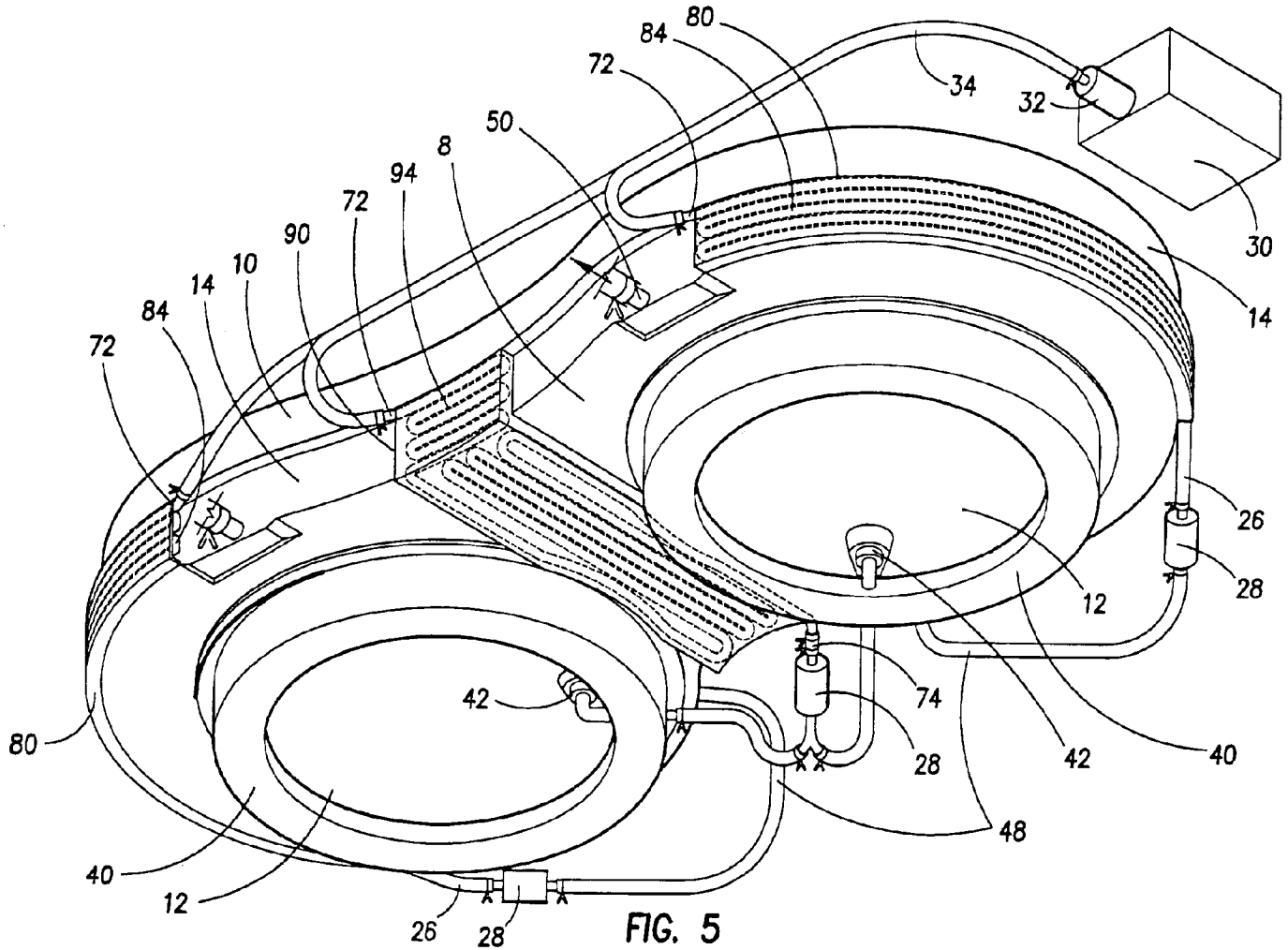
FIG. 5 is a perspective view from the rear of a motor housing with a cleaning fluid heating chamber according to a further alternative embodiment of the invention.

While more costly to produce, a further embodiment of the invention may incorporate additional heat conducting material to further improve the cleaning effectiveness of the cleaning fluid by maintaining it at a higher temperature than would be attainable otherwise. Such an alternate embodiment is shown in FIGS. 3 and 4, where the heating chamber 80 forms a shell about a conduit such as piping 84, holding it in place. Piping 84 is constructed of a heat conducting, non-rusting metal, preferably copper. However, any material meeting the necessary criteria (heat conducting and non-rusting) would be satisfactory. The conduit need not take the specific form of piping, but instead need only provide channels or the like within which cleaning fluid may be contained and which provides an increased surface area of heat conducting material in contact with the cleaning fluid. Components in FIGS. 3–6 identical to those of the preferred embodiment shown in FIGS. 1 and 2 have been identified with identical reference numbers.

The piping 84 has inlet 72 and outlet 74. Layers of piping 84 are sandwiched within the heating chamber 80 in abutment with the perimeter side wall 14 of the motor housing 10. Preferably heating chamber 80 is also made of a heat conducting material and is fixedly connected to the motor housing thereby holding the piping in abutment with the perimeter side wall 14 of the motor housing. A pair of heating chambers 80 with interior piping 84 are located at opposite sides of the motor housing and shaped to follow the contour of the perimeter side wall 14 from the front to the rear of the motor housing 10 as best shown in FIG. 3.

Cleaning fluid from cleaning fluid reservoir 30 is delivered by pump 32 through conduits 34 and inlets 72 into piping 84. Once in the piping, the cleaning fluid is heated via conduction in a similar fashion to the preferred embodiment. However, because there is more heat conducting material and less of the cleaning fluid, the cleaning fluid may be heated at a faster rate and to a higher overall temperature.

The cleaning fluid leaves the piping 84 via outlets 74 and as in the preferred embodiment is delivered via fluid delivery means to areas of the range hood requiring cleaning.

The positioning of the heating chamber may be varied provided that it remains positioned adjacent to and in close proximity to the motor housing periphery. For example, in the alternative embodiment shown in FIG. 5, an additional heating chamber 90 with piping 94 is positioned between the grease trays 40 adjacent the bottom surface 8 and a rear portion of the perimeter side wall 14. Chamber 90 is shaped so that it does not interfere with the removability of the grease trays 40. If desired, the size and positioning of the chamber 90 may be varied so as to come into contact with a greater amount of the motor housing periphery.

Figure 6:
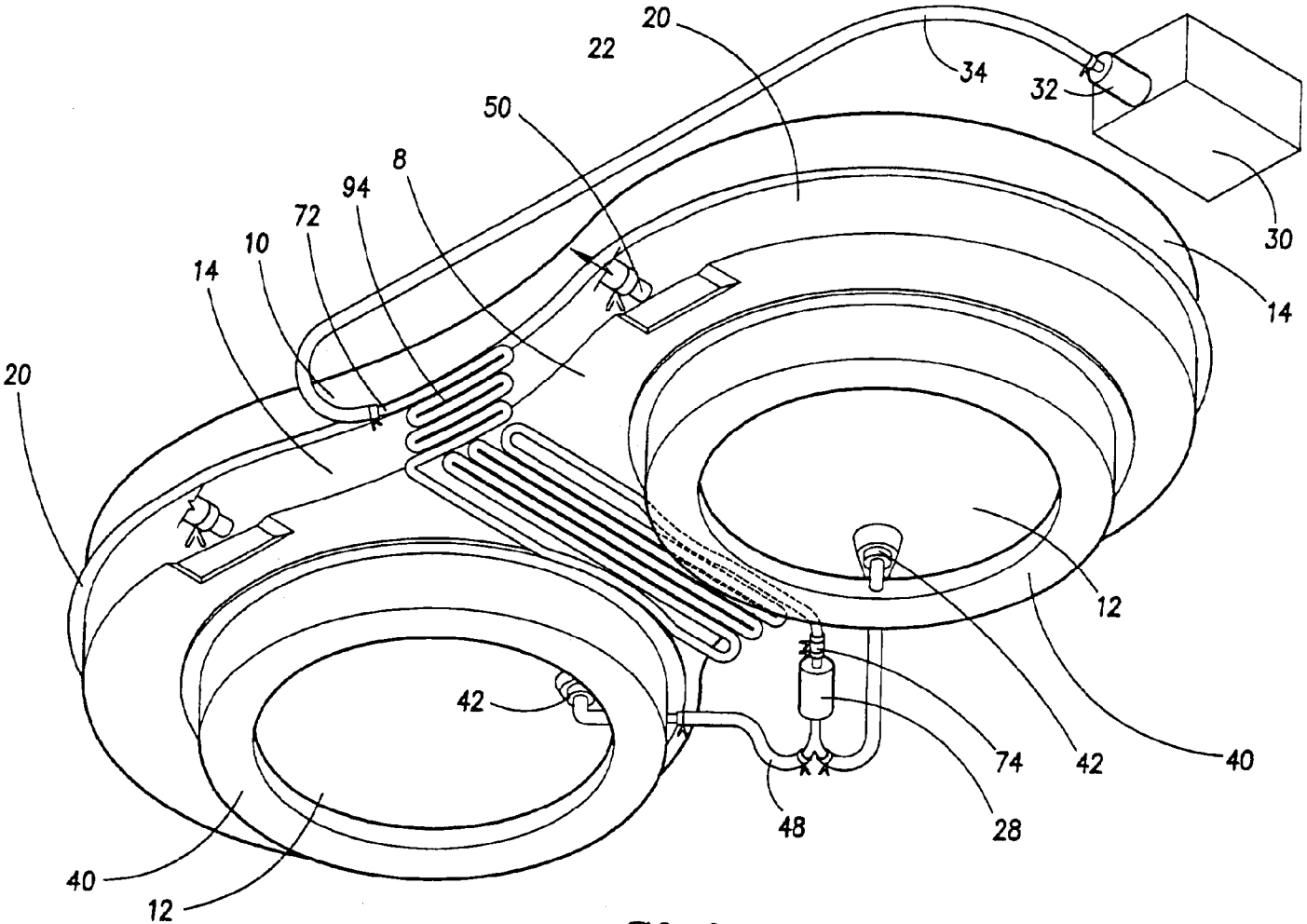
FIG. 6 is a perspective view from the rear of a motor housing with a cleaning fluid heating chamber according to yet a further alternative embodiment of the invention.

FIG. 6 shows a further alternative embodiment, where the conduit 94 is not contained within a shell, but rather the conduit 94, in this case piping, is the heating chamber. The piping 94 is connected by welding or other connections means such that it is held substantially adjacent, or in abutment to, a portion of the motor housing periphery.

It is contemplated that the preferred and alternative embodiments of a heating chamber according to the invention may be adapted to be used in conjunction with a variety of motor housing designs beyond that which was disclosed herein.

It will be appreciated by those skilled in the art that the preferred and alternative embodiments have been described in some detail but that certain modifications may be practiced without departing from the principles of the invention.

What is claimed is:

1. A cleaning fluid heating chamber for use in a range hood having a motor housing having a periphery defined by top, bottom and perimeter side surfaces, wherein said heating chamber comprises a solid outer shell defining an enclosure and a conduit contained within said enclosure, wherein said heating chamber is positioned substantially adjacent a portion of said periphery of said motor housing, wherein said conduit is a length of piping, wherein said piping is in abutment with said periphery of said motor housing, wherein said piping being sandwiched in layers within said enclosure, and wherein each of said layers of said piping is in abutment with said perimeter side surface of said motor housing.

2. The cleaning fluid heating chamber of claim 1, wherein said conduit has an inlet and an outlet.

3. The cleaning fluid heating chamber of claim 1, wherein said conduit is made of a heat conducting material.

4. The cleaning fluid heating chamber of claim 1, wherein said piping is made of copper.

* * * * *